US011231679B2

(12) United States Patent
Miyawaki et al.

(10) Patent No.: US 11,231,679 B2
(45) Date of Patent: Jan. 25, 2022

(54) ATTACHABLE-DETACHABLE UNIT AND IMAGE FORMING APPARATUS

(71) Applicant: FUJIFILM Business Innovation Corp., Tokyo (JP)

(72) Inventors: Satoshi Miyawaki, Kanagawa (JP); Tatsuya Tamai, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/384,950

(22) Filed: Apr. 16, 2019

(65) Prior Publication Data

US 2020/0192271 A1 Jun. 18, 2020

(30) Foreign Application Priority Data

Dec. 18, 2018 (JP) ..... JP2018-236595

(51) Int. Cl.
*G03G 21/16* (2006.01)
*G03G 15/08* (2006.01)

(52) U.S. Cl.
CPC ..... *G03G 21/1647* (2013.01); *G03G 15/0865* (2013.01); *G03G 15/0891* (2013.01); *G03G 21/1676* (2013.01)

(58) Field of Classification Search
CPC .... B07B 1/20; G03G 21/105; G03G 21/1647; G03G 15/0865; G03G 15/0891; G03G 21/1676
See application file for complete search history.

(56) References Cited

U.S. PATENT DOCUMENTS 310,791 A * 1/1885 Campbell ..... B07B 1/20 209/283
2014/0029962 A1* 1/2014 Shimizu ..... G03G 15/0856 399/27
2015/0003881 A1* 1/2015 Shima ..... G03G 21/105 399/360
2015/0139697 A1* 5/2015 Tsukijima ..... G03G 15/0893 399/254
2017/0060032 A1* 3/2017 Iida ..... G03G 15/0893
2017/0060074 A1* 3/2017 Mizutani ..... G03G 21/105
2017/0364024 A1* 12/2017 Otomura ..... G03G 21/105
2018/0129152 A1* 5/2018 Iida ..... G03G 15/0935
2018/0267459 A1 9/2018 Sato et al.
2020/0096909 A1* 3/2020 Nakajima ..... G03G 15/0889

FOREIGN PATENT DOCUMENTS

JP 2018155959 10/2018

OTHER PUBLICATIONS

Lorenzetti, Ambrogio, Allegoria ed effetti del Buono e del Cattivo Governo (Year: 1338).*

* cited by examiner

*Primary Examiner* — Sevan A Aydin
(74) *Attorney, Agent, or Firm* — JCIPRNET

(57) ABSTRACT

An attachable-detachable unit that is attachable to and detachable from a body. The unit includes a storage portion having a storage space in which powder is stored, the storage space including a bottom part that is continuous in one direction and a narrow region in which the storage space seen in the one direction has a smaller sectional area than in an other region; and a transport member extending in the one direction in the storage space and transporting the powder in the one direction such that at least some of the powder passes through the narrow region.

15 Claims, 14 Drawing Sheets

ATTACHABLE-DETACHABLE UNIT AND IMAGE FORMING APPARATUS

CROSS-REFERENCE TO RELATED APPLICATIONS

This application is based on and claims priority under 35 USC 119 from Japanese Patent Application No. 2018-236595 filed Dec. 18, 2018.

BACKGROUND

(i) Technical Field

The present disclosure relates to an attachable-detachable unit and an image forming apparatus.

(ii) Related Art

A process cartridge disclosed by Japanese Unexamined Patent Application Publication No. 2018-155959 includes a drum cartridge and a toner cartridge. The drum cartridge includes a photoconductive drum and a developing roller. When the toner cartridge is attached to the drum cartridge, the toner cartridge is positioned across the developing roller from the photoconductive drum. The drum cartridge includes a cleaner, a transport tube, and a developing device including a developing chamber. The toner cartridge includes a waste-toner storage portion and a toner storage portion. At least part of the toner storage portion is positioned between the waste-toner storage portion and the developing chamber. Seen in the axial direction of the photoconductive drum, the transport tube overlaps the photoconductive drum, the toner storage portion, and the waste-toner storage portion.

SUMMARY

If an attachable-detachable unit such as the process cartridge including the waste-toner storage portion is tilted after being detached from the body of an image forming apparatus, powder such as toner stored in a storage space provided in the waste-toner storage portion may gather toward the upstream side or the downstream side in a direction in which a transport member transports the powder.

Aspects of non-limiting embodiments of the present disclosure relate to more assuredly suppressing the gathering of the powder toward the upstream side or the downstream side in the direction of transport by the transport member even if the attachable-detachable unit is tilted, than in a configuration in which the sectional area of the storage space is uniform in one particular direction.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an attachable-detachable unit that is attachable to and detachable from a body. The unit includes a storage portion having a storage space in which powder is stored, the storage space including a bottom part that is continuous in one direction and a narrow region in which the storage space seen in the one direction has a smaller sectional area than in an other region; and a transport member extending in the one direction in the storage space and transporting the powder in the one direction such that at least some of the powder passes through the narrow region.

BRIEF DESCRIPTION OF THE DRAWINGS

An exemplary embodiment of the present disclosure will be described in detail based on the following figures, wherein.

DETAILED DESCRIPTION

Figure 1:
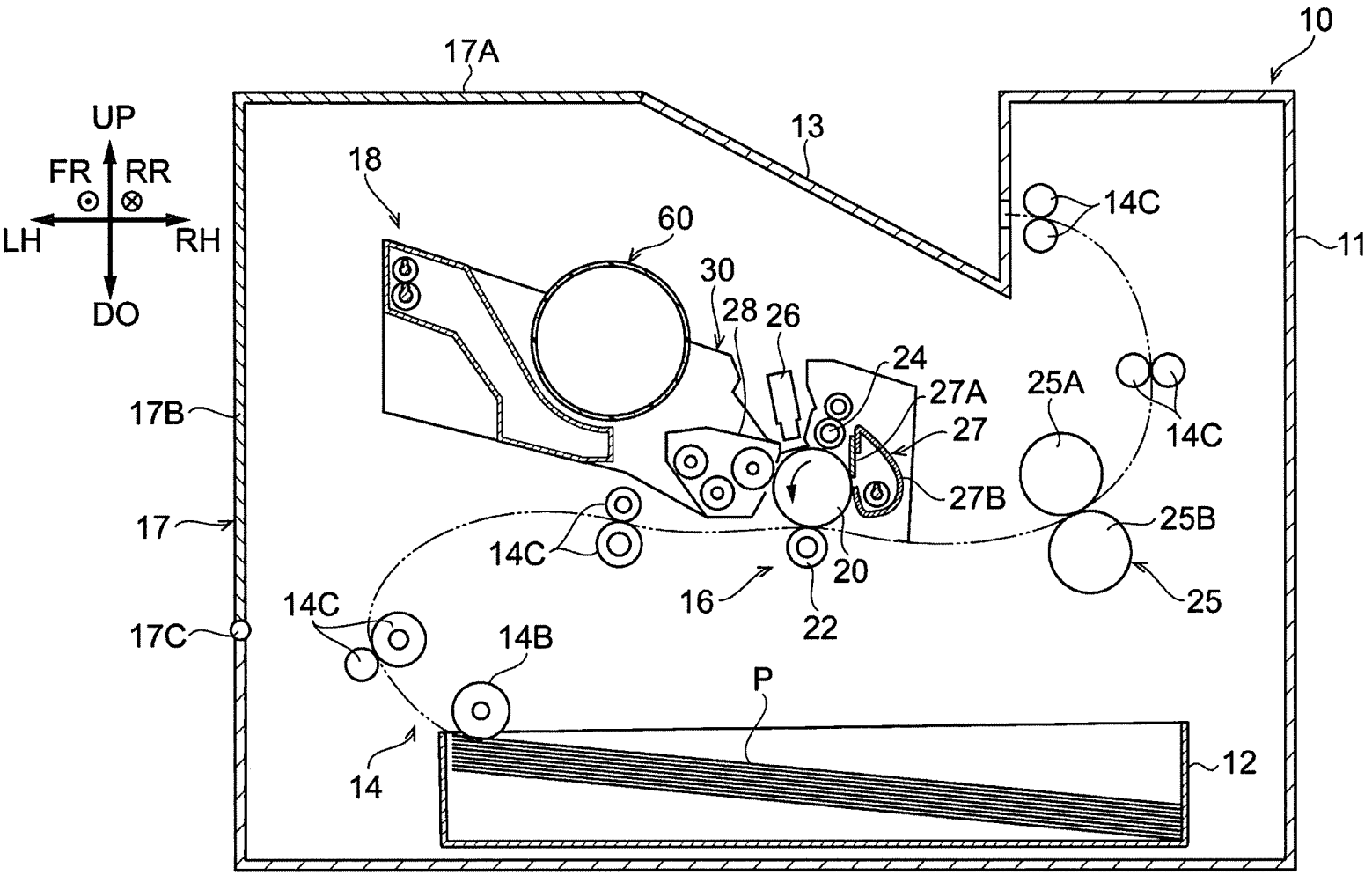
FIG. 1 is a schematic diagram of an image forming apparatus according to the exemplary embodiment.

An exemplary embodiment of the present disclosure will now be described with reference to the drawings.

In the drawings, arrow UP points toward the upper side (the upper side in the vertical direction) of an apparatus, arrow DO points toward the lower side (the lower side in the vertical direction) of the apparatus, arrow LH points toward the left side of the apparatus, arrow RH points toward the right side of the apparatus, arrow FR points toward the front side of the apparatus, and arrow RR points toward the rear side of the apparatus. These directions are defined for convenience of description and do not limit the configuration of the apparatus. The above terms representing the directions of the apparatus may be used without the term "apparatus". For example, "the upper side of the apparatus" may also be referred to as "the upper side", simply.

In the following description, the term "vertical direction" refers to "directions toward both the upper side and the lower side" or "a direction toward one of the upper side and the lower side". Likewise, the term "horizontal direction" refers to "directions toward both the right side and the left side" or "a direction toward one of the right side and the left side". The term "horizontal direction" corresponds to the width direction of the apparatus and is also regarded as a lateral direction or a level direction. The term "front-rear direction" refers to "directions toward both the front side and the rear side" or "a direction toward one of the front side and the rear side". The "front-rear direction" corresponds to the depth direction of the apparatus and is also regarded as another lateral direction or another level direction. The vertical direction, the horizontal direction, and the front-rear direction are directions intersecting one another (specifically, directions orthogonal to one another).

In addition, an encircled cross represents an arrow heading from the near side toward the far side with respect to the plane of each of the drawings, and an encircled dot represents an arrow heading from the far side toward the near side with respect to the plane of each of the drawings.

Image Forming Apparatus 10

An image forming apparatus 10 according to an exemplary embodiment will now be described. FIG. 1 is a schematic diagram of the image forming apparatus 10 according to the present exemplary embodiment.

The image forming apparatus 10 illustrated in FIG. 1 is an exemplary image forming apparatus that forms an image on a recording medium. Specifically, the image forming apparatus 10 is an electrophotographic image forming apparatus that forms a toner image (an exemplary image) on a sheet P (an exemplary recording medium). More specifically, the image forming apparatus 10 includes an image-forming-apparatus body 11, an openable-closable portion 17, a sheet container 12, a transport section 14, and an image forming section 16. Now, individual elements of the image forming apparatus 10 will be described.

Image-Forming-Apparatus Body 11 and Openable-Closable Portion 17

The image-forming-apparatus body 11 is an exemplary body. The image-forming-apparatus body 11 serves as a housing that houses relevant elements. The openable-closable portion 17 is openably and closably attached to the image-forming-apparatus body 11.

The openable-closable portion 17 has an L shape when seen in the front-rear direction. Specifically, the openable-closable portion 17 includes a top plate 17A positioned above an image forming unit 18, and a side plate 17B positioned on the left side of the image forming unit 18. The openable-closable portion 17 further includes a rotating shaft 17C provided at the lower end of the side plate 17B and whose axis extends in the front-rear direction.

The openable-closable portion 17 is rotatable on the rotating shaft 17C, thereby being movable between a closed position (see FIG. 1) at which the openable-closable portion 17 covers the interior of the image-forming-apparatus body 11 and an open position (see FIG. 2) at which the openable-closable portion 17 exposes the interior of the image-forming-apparatus body 11.

Sheet Container 12 and Sheet Output Portion 13

The sheet container 12 is a container in which sheets P are contained in such a manner as to be stacked one on top of another. The sheet container 12 is positioned at the bottom of the image-forming-apparatus body 11.

A sheet output portion 13 is an output portion to which sheets P are outputted. The sheet output portion 13 receives sheets P that are outputted one by one from the image-forming-apparatus body 11 in such a manner as to be stacked thereon. The sheet output portion 13 is provided at the top (in the upper surface) of the image-forming-apparatus body 11.

Transport Section 14

The transport section 14 transports each of the sheets P. Specifically, the transport section 14 has a function of transporting the sheets P one by one from the sheet container 12 to the sheet output portion 13. More specifically, the transport section 14 includes a feed roller 14B and a plurality of pairs of transport rollers 14C. The feed roller 14B feeds the sheets P one by one from the sheet container 12. The plurality of pairs of transport rollers 14C receive each sheet P fed thereto by the feed roller 14B and transport the sheet P to the sheet output portion 13 via the image forming section 16.

Image Forming Section 16

The image forming section 16 forms an image. Specifically, the image forming section 16 has a function of forming an image on the sheet P with toner. The toner is exemplary powder.

More specifically, the image forming section 16 includes the image forming unit 18, an exposure device 26, a transfer roller 22, and a fixing device 25. The image forming unit 18 forms a black toner image. The black toner image is an exemplary image. The image forming unit 18 includes a photoconductor drum 20, a charging roller 24 as a charging device, a developing device 28, and a remover 27. The photoconductor drum 20 is an exemplary photoconductor.

The photoconductor drum 20 rotates in one direction (counterclockwise in FIG. 1). The charging roller 24, the exposure device 26, the developing device 28, the transfer roller 22, and the remover 27 are arranged around the photoconductor drum 20 in that order from the upstream side in the direction of rotation of the photoconductor drum 20.

In the image forming unit 18, the charging roller 24 charges the photoconductor drum 20. The charged photoconductor drum 20 is exposed to light emitted from the exposure device 26, whereby an electrostatic latent image (an exemplary latent image) is formed thereon. The developing device 28 develops the electrostatic latent image formed on the photoconductor drum 20 by the exposure device 26 into a toner image. The toner image formed by the developing device 28 is transferred to a sheet P by the transfer roller 22.

The remover 27 removes toner remaining on the surface of the photoconductor drum 20 having undergone the above transfer. Specifically, the remover 27 includes a blade 27A as a removing member that is in contact with the surface of the photoconductor drum 20 and thus removes (scrapes) the toner, and a toner storage portion 27B that stores the toner removed by the blade 27A. More details of the image forming unit 18 will be described separately below.

The fixing device 25 fixes the toner image transferred to the sheet P. Specifically, the fixing device 25 includes a heating roller 25A and a pressing roller 25B. In the fixing device 25, the toner image on the sheet P is fixed with heat and pressure applied thereto from the heating roller 25A and the pressing roller 25B, respectively.

Details of Image Forming Unit 18

Details of the image forming unit 18 will now be described.

Figure 2:
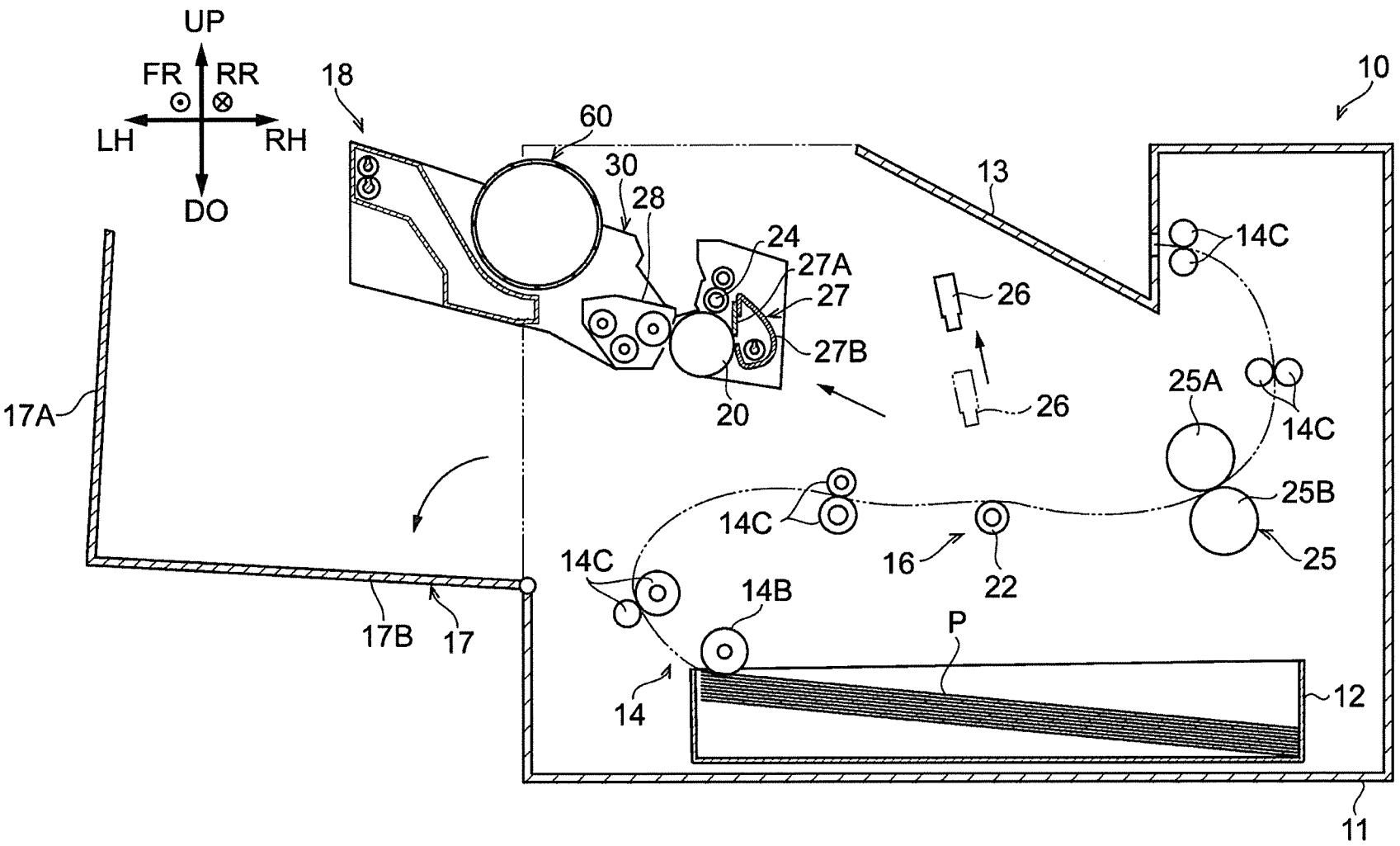
FIG. 2 is a schematic diagram of the image forming apparatus illustrated in FIG. 1, with an openable-closable portion being open.

The image forming unit 18 illustrated in FIGS. 1 and 2 is an exemplary attachable-detachable unit and is attachable to and detachable from the image-forming-apparatus body 11. Specifically, the image forming unit 18 is provided in the form of an exchangeable process cartridge intended for the image-forming-apparatus body 11. As illustrated in FIG. 2, when the openable-closable portion 17 is at the open position, the image forming unit 18 is allowed to be attached to or detached from the image-forming-apparatus body 11.

More specifically, the image forming unit 18 is allowed to be attached to or detached from the image-forming-apparatus body 11 with, for example, the exposure device 26 being retracted to such a position as not to interfere with the image forming unit 18. In FIG. 2, the exposure device 26 that is not retracted is illustrated by a two-dot chain line, and the exposure device 26 that is retracted is illustrated by a solid line.

Figure 6:
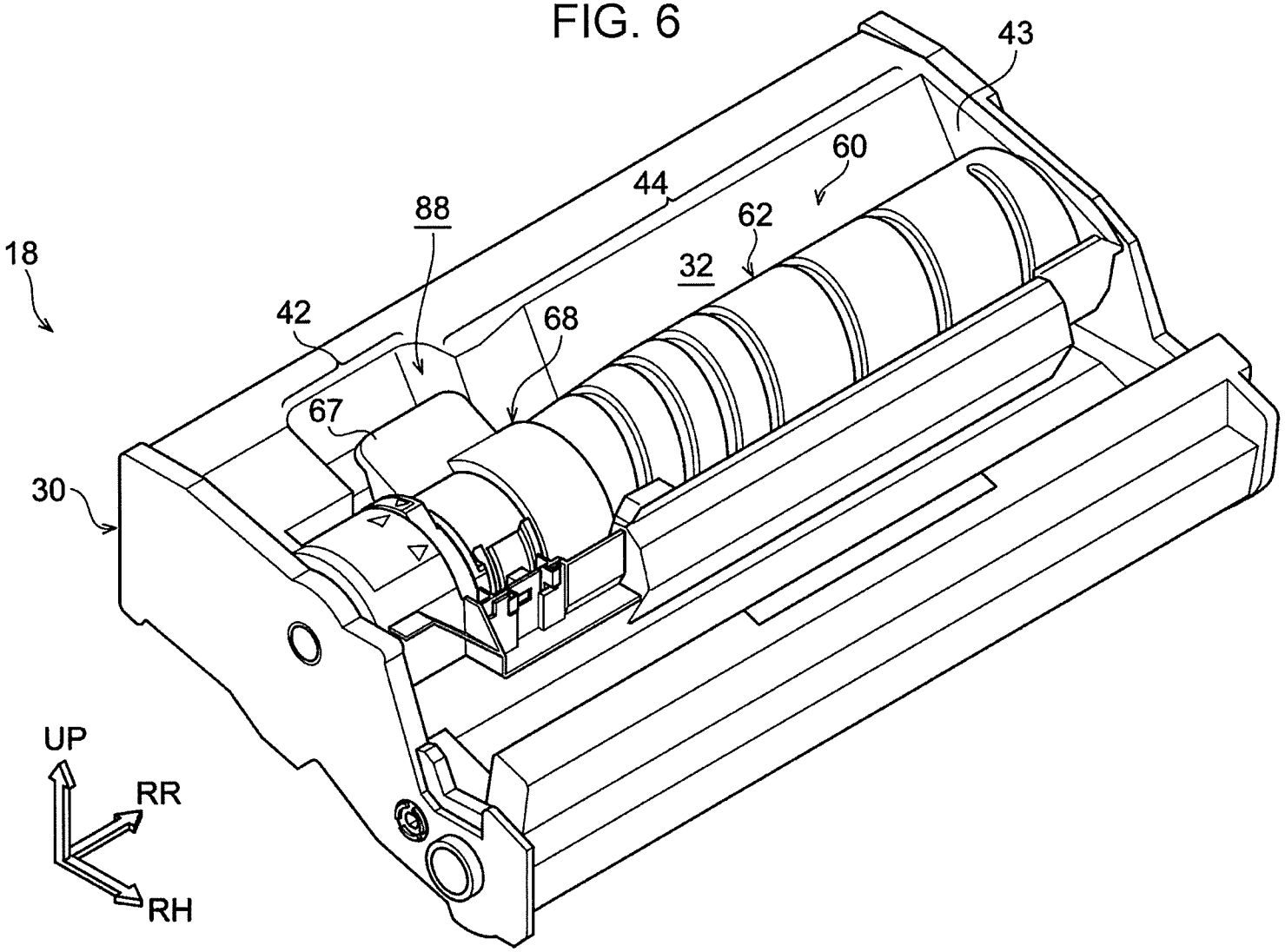
FIG. 6 is a perspective view of the image forming unit illustrated in FIG. 4, with the storage container being set in the unit body.
Figure 7:
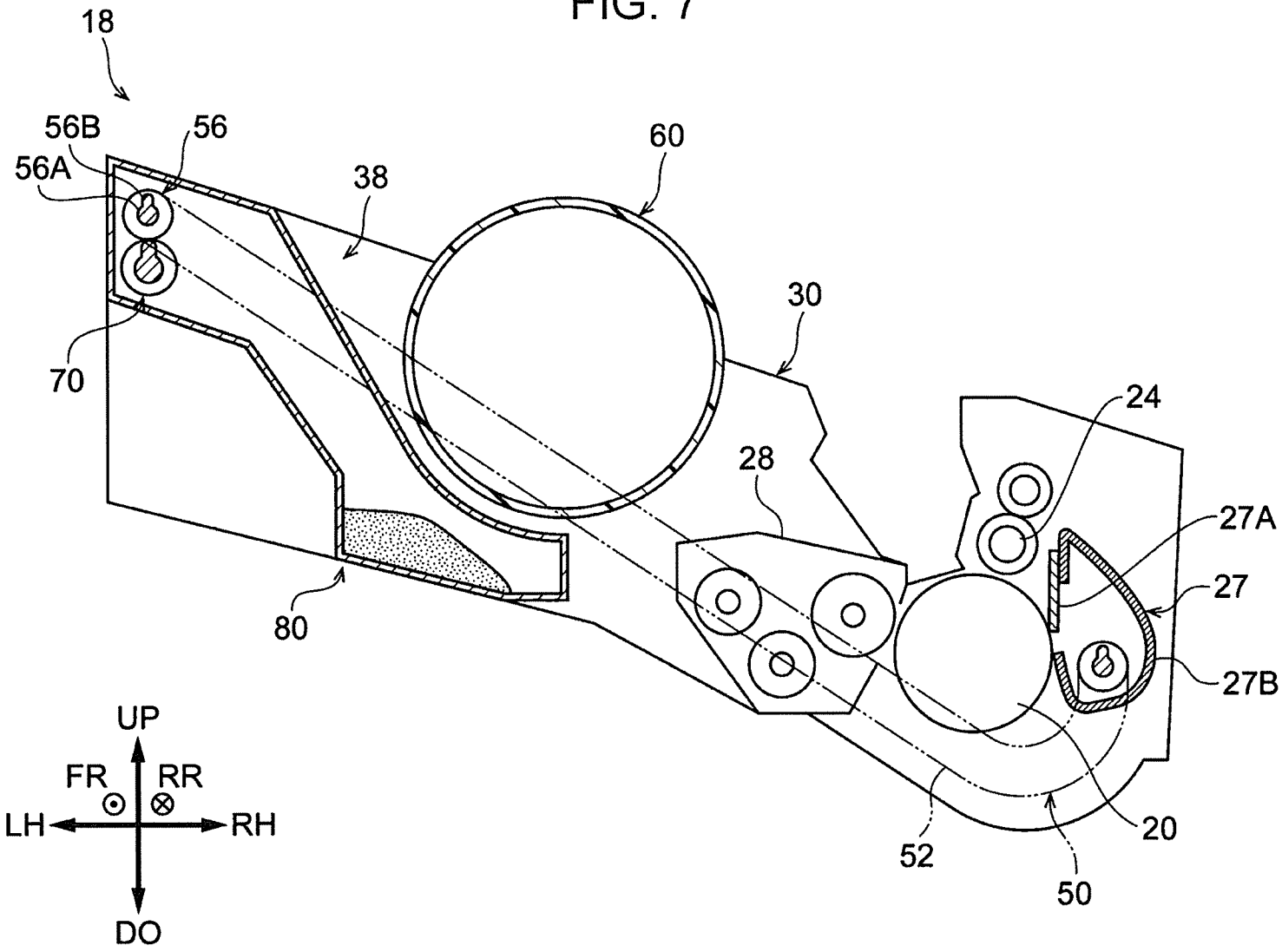
FIG. 7 is a sectional view of the image forming unit according to the exemplary embodiment.

As described above, the image forming unit 18 includes the photoconductor drum 20, the charging roller 24 as a charging device, the developing device 28, and the remover 27. As illustrated in FIGS. 1 and 6, the image forming unit 18 further includes a unit body 30 and a storage container 60. As illustrated in FIG. 7, the image forming unit 18 further includes a transport mechanism 50, a waste-toner storage portion 38, and a transport member 70.

Unit Body 30

As illustrated in FIG. 1, the unit body 30 is a structure provided with elements of the image forming unit 18, such as the photoconductor drum 20, the charging roller 24, the developing device 28, and the remover 27. The unit body 30 is also regarded as a supporting body that supports the photoconductor drum 20, the charging roller 24, elements forming the developing device 28, elements forming the remover 27, and so forth.

Figure 3:
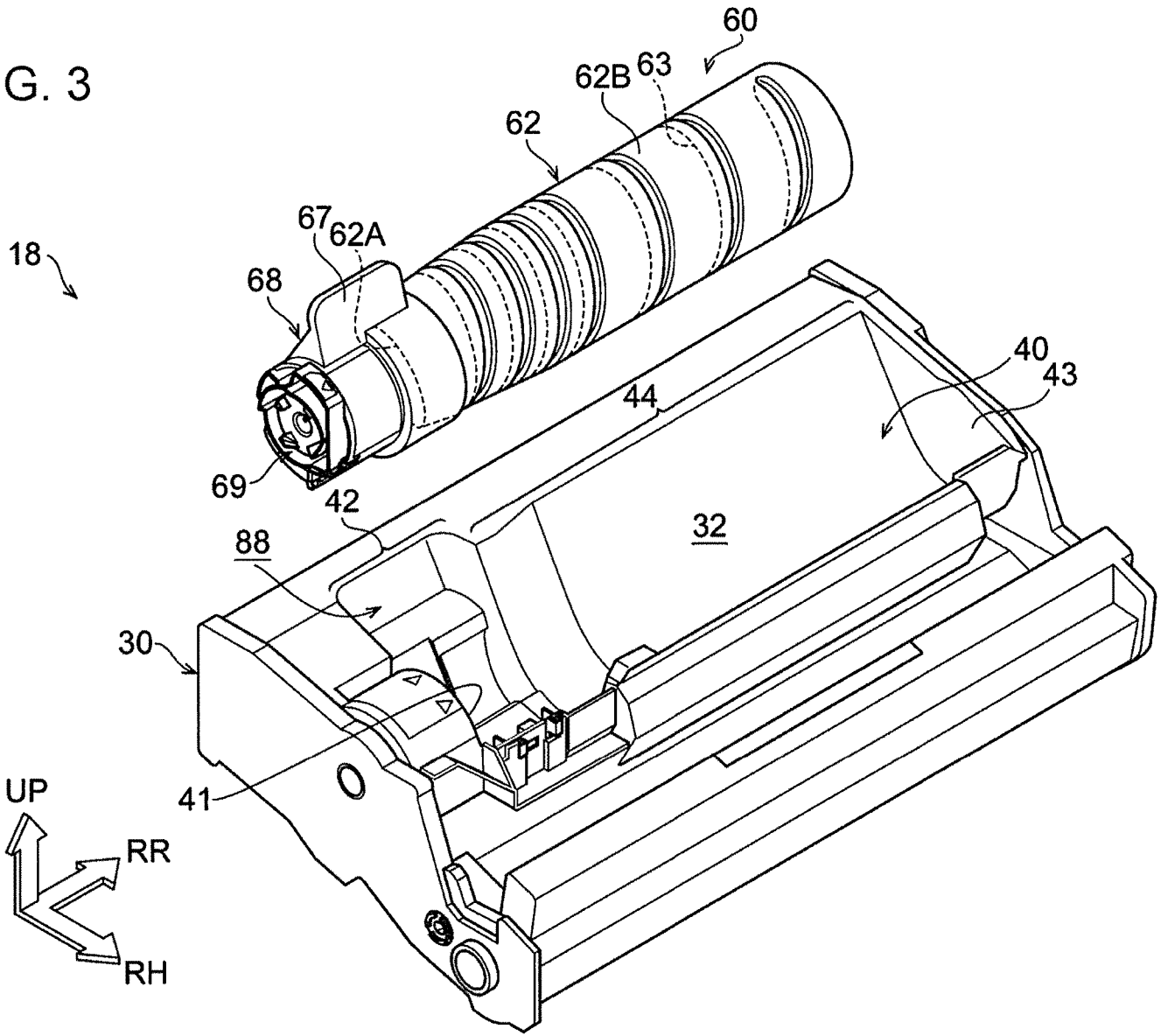
FIG. 3 is a perspective view of an image forming unit according to the exemplary embodiment.

As illustrated in FIG. 3, the unit body 30 has a placing space 32 in which the storage container 60 is to be placed. The placing space 32 is open on the upper side. The storage container 60 is placed into the placing space 32 from the upper side.

As illustrated in FIG. 3, the unit body 30 includes a wall portion 40 that defines the placing space 32. The wall portion 40 includes a front wall 41 (see FIG. 4), a rear wall 43, a front peripheral wall 42, and a rear peripheral wall 44.

Figure 5:
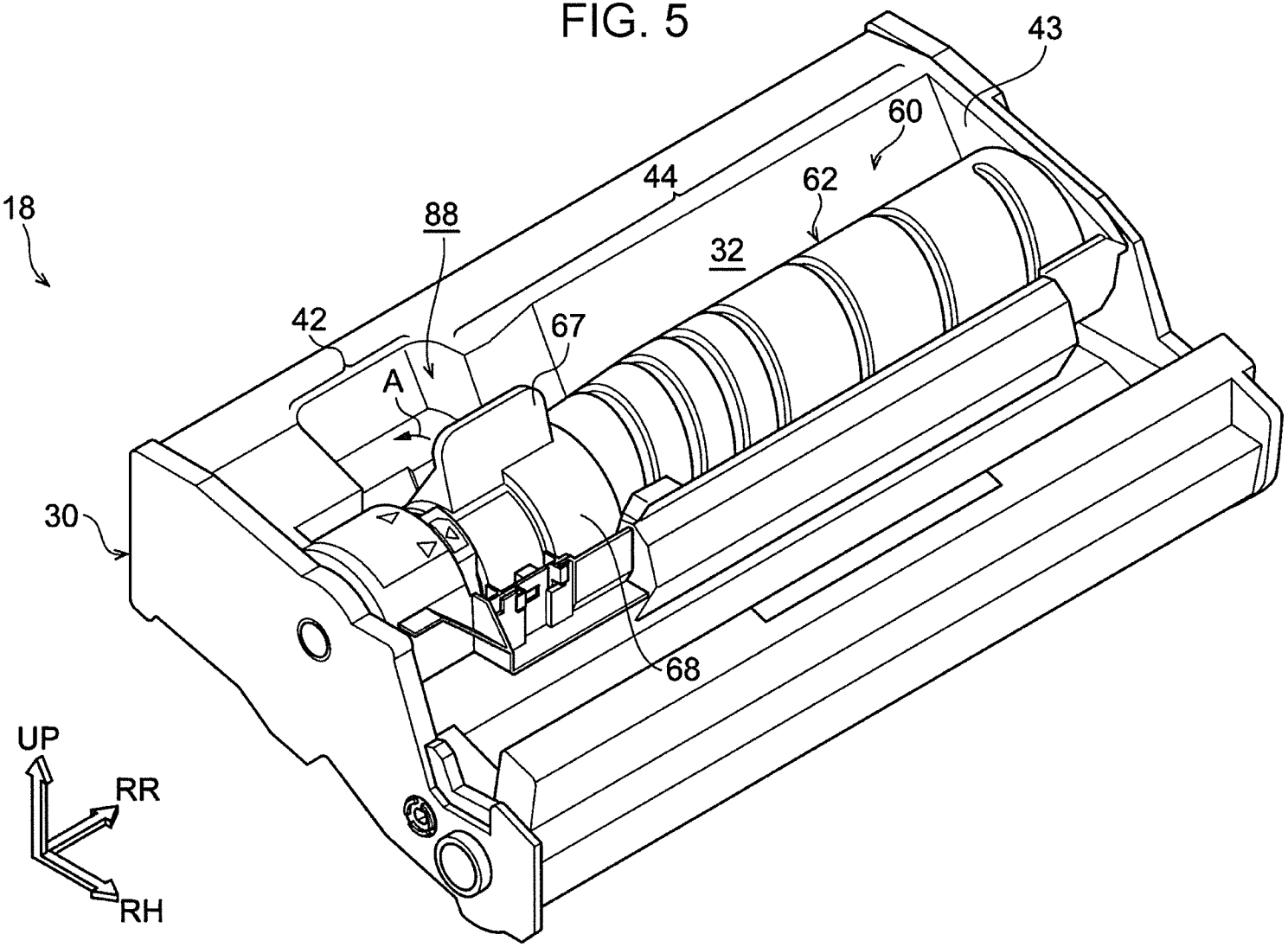
FIG. 5 is a perspective view of the image forming unit illustrated in FIG. 3, with a storage container being placed in a placing space.

The front peripheral wall 42 is positioned on the front side of the unit body 30. Specifically, the front peripheral wall 42 is a wall positioned on the front side with respect to the rear peripheral wall 44 and extending in the front-rear direction. As illustrated in FIGS. 5 and 6, the front peripheral wall 42 extends around the periphery (specifically, on the right side, the lower side, and the left side) of a lid portion 68, to be described below, of the storage container 60 placed in the placing space 32.

Figure 4:
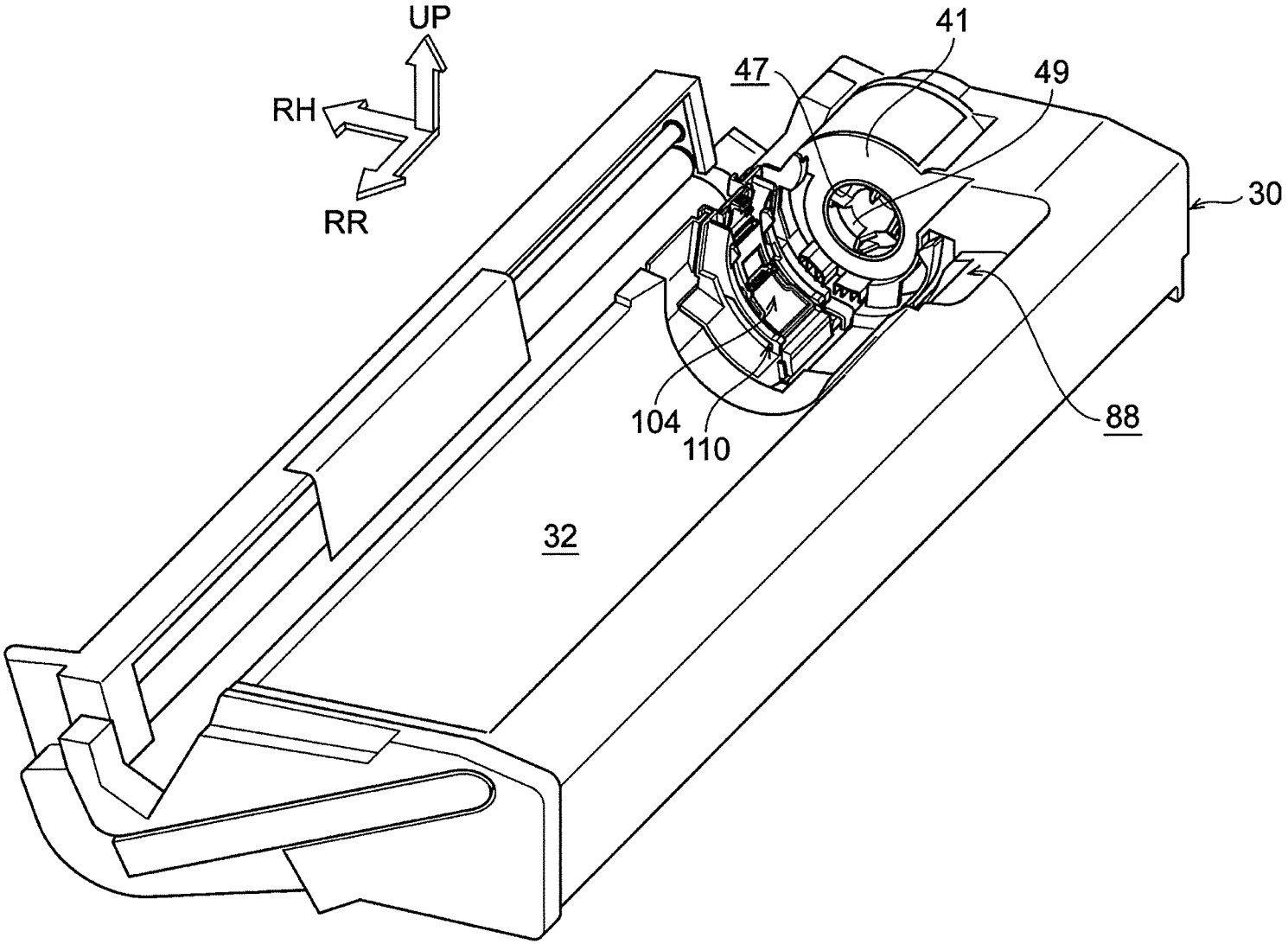
FIG. 4 is a perspective view of a unit body of the image forming unit according to the exemplary embodiment.

As illustrated in FIG. 4, the front peripheral wall 42 is provided with an openable-closable member 104 that opens and closes an inlet (not illustrated) provided in the front peripheral wall 42.

As illustrated in FIG. 3, the rear peripheral wall 44 is a wall positioned on the rear side with respect to the front peripheral wall 42 and extending in the front-rear direction. The rear peripheral wall 44 extends around the periphery (specifically, on the right side, the lower side, and the left side) of a storage portion 62, to be described below, of the storage container 60 placed in the placing space 32.

The storage container 60 is placed into the placing space 32 (see FIG. 5) by bringing the storage container 60 from the upper side of the placing space 32 (see FIG. 3) toward the lower side into the placing space 32. Furthermore, the storage container 60 thus placed in the placing space 32 is rotated in a direction represented by arrow A illustrated in FIG. 5, whereby the lid portion 68 of the storage container 60 is supported by a supporting portion 110 (see FIG. 4). Thus, the storage container 60 is completely set in the unit body 30 (see FIG. 6).

With the above rotating operation in which the storage container 60 is rotated in the direction of arrow A illustrated in FIG. 5, an openable-closable member (not illustrated) provided on the below-described lid portion 68 of the storage container 60 and the openable-closable member 104 provided on the front peripheral wall 42 are opened. Consequently, an outlet (not illustrated) provided in the below-described lid portion 68 of the storage container 60 and the inlet (not illustrated) provided in the front peripheral wall 42 communicate with each other. Thus, toner stored in the storage container 60 is allowed to be supplied into the inlet (not illustrated).

The storage container 60 is attachable to and detachable from the unit body 30 in either of the following states: a state where the image forming unit 18 is set in the image-forming-apparatus body 11 (see FIG. 1), and a state where the image forming unit 18 is off the image-forming-apparatus body 11 (see FIG. 2).

As illustrated in FIG. 4, the front wall 41 is a wall facing toward the rear side. The front wall 41 has a circular hole 47. A transmitting portion 49 is provided in the circular hole 47. The transmitting portion 49 is connected to a transmitting portion 69 (see FIG. 3), to be described below, of the storage container 60. Specifically, the transmitting portion 49 is a coupling that meshes with the transmitting portion 69 in the front-rear direction.

Storage Container 60

The storage container 60 illustrated in FIGS. 3 and 5 is an exemplary rotating body. The storage container 60 is a container in which toner is stored. Specifically, the toner stored in the storage container 60 is to be supplied to the developing device 28 (an exemplary supply destination). In other words, the storage container 60 stores toner yet to be used, i.e., fresh toner.

As illustrated in FIG. 3, the storage container 60 is elongated in the front-rear direction (an exemplary one direction). Specifically, the storage container 60 includes the storage portion 62, the lid portion 68, and the transmitting portion 69.

Storage Portion 62

The storage portion 62 illustrated in FIG. 3 is a portion of the storage container 60 in which toner is stored. The storage portion 62 is integrally molded from a resin material. Specifically, the storage portion 62 extends in the front-rear direction. More specifically, the storage portion 62 has a substantially cylindrical bottomed shape with a closed rear end and an axis extending in the front-rear direction. In other words, the storage portion 62 has a cylindrical outer peripheral surface. Furthermore, the diameter of a front part of the storage portion 62 is gradually reduced toward the front side. As illustrated in FIG. 3, the storage portion 62 has a mouth part 62A at the front end.

As illustrated in FIG. 3, the storage portion 62 has a helical ridge 63 provided on the inner surface of a peripheral wall 62B and projecting inward. In the storage container 60, when the storage portion 62 rotates in the peripheral direction thereof, the toner stored in the storage portion 62 is transported by the helical ridge 63 from the rear side toward the front side. That is, the toner stored in the storage portion 62 moves toward the lid portion 68.

Lid Portion 68

As illustrated in FIG. 3, the lid portion 68 has a function of closing the mouth part 62A of the storage portion 62. The lid portion 68 supports, at the rear end thereof, the front end of the storage portion 62 such that the storage portion 62 is rotatable on an axis extending in the front-rear direction. The lid portion 68 is integrally molded from a resin material. The lid portion 68 has a substantially cylindrical bottomed shape with an open rear end and a closed front end. The inside of the lid portion 68 communicates with the inside of the storage portion 62 through the mouth part 62A of the storage portion 62. Hence, the toner in the storage portion 62 that is moved toward the lid portion 68 further moves into the lid portion 68 through the mouth part 62A.

As described above, when the storage container 60 placed in the placing space 32 (see FIG. 5) is rotated in the direction of arrow A illustrated in FIG. 5, the lid portion 68 is supported by the supporting portion 110 (see FIG. 4). In this state, the storage portion 62 is not supported and is not bound to the unit body 30. Hence, the rear end of the storage container 60 is movable toward, for example, the upper side. In other words, the storage container 60 is supported in a cantilever manner at the front end.

Operated Portion 67

An operated portion 67 illustrated in FIGS. 3, 5, and 6 is operated by a worker (an operator) in a placing operation in which the storage container 60 is placed into the placing space 32 or in a setting operation in which the storage container 60 is set in the unit body 30. Specifically, for example, in the placing operation in which the storage container 60 is placed into the placing space 32 from the upper side of the placing space 32 (see FIG. 3), the operated portion 67 is gripped by the worker (the operator). Furthermore, in the rotating operation (the setting operation) in which the storage container 60 placed in the placing space 32 is rotated in the direction of arrow A illustrated in FIG. 5, the operated portion 67 is pushed by the worker (the operator).

As illustrated in FIG. 3, the operated portion 67 projects from the lid portion 68 toward the outer side in the radial direction of the lid portion 68. The operated portion 67 has a plate shape with a certain thickness in the peripheral direction of the lid portion 68.

Transmitting Portion 69

The transmitting portion 69 illustrated in FIG. 3 transmits a driving force generated by a drive unit (not illustrated) to the storage portion 62. The transmitting portion 69 is connected to the storage portion 62 inside the lid portion 68. Specifically, the transmitting portion 69 is a coupling that meshes with the transmitting portion 49 (see FIG. 4) in the front-rear direction.

In the present exemplary embodiment, as illustrated in FIG. 5, the storage container 60 placed in the placing space 32 is rotated in the direction of arrow A illustrated in FIG. 5, whereby a moving mechanism (not illustrated) moves the transmitting portion 49 toward the rear side and causes the transmitting portion 49 to project from the circular hole 47. Thus, the transmitting portion 49 is connected to the transmitting portion 69 of the storage container 60. Then, the driving force generated by the drive unit (not illustrated) is transmitted to the storage portion 62 through the transmitting portion 49 and the transmitting portion 69. Consequently, while the lid portion 68 is prevented from rotating, the storage portion 62 rotates on the axis extending in the front-rear direction.

Transport Mechanism 50

Figure 9:
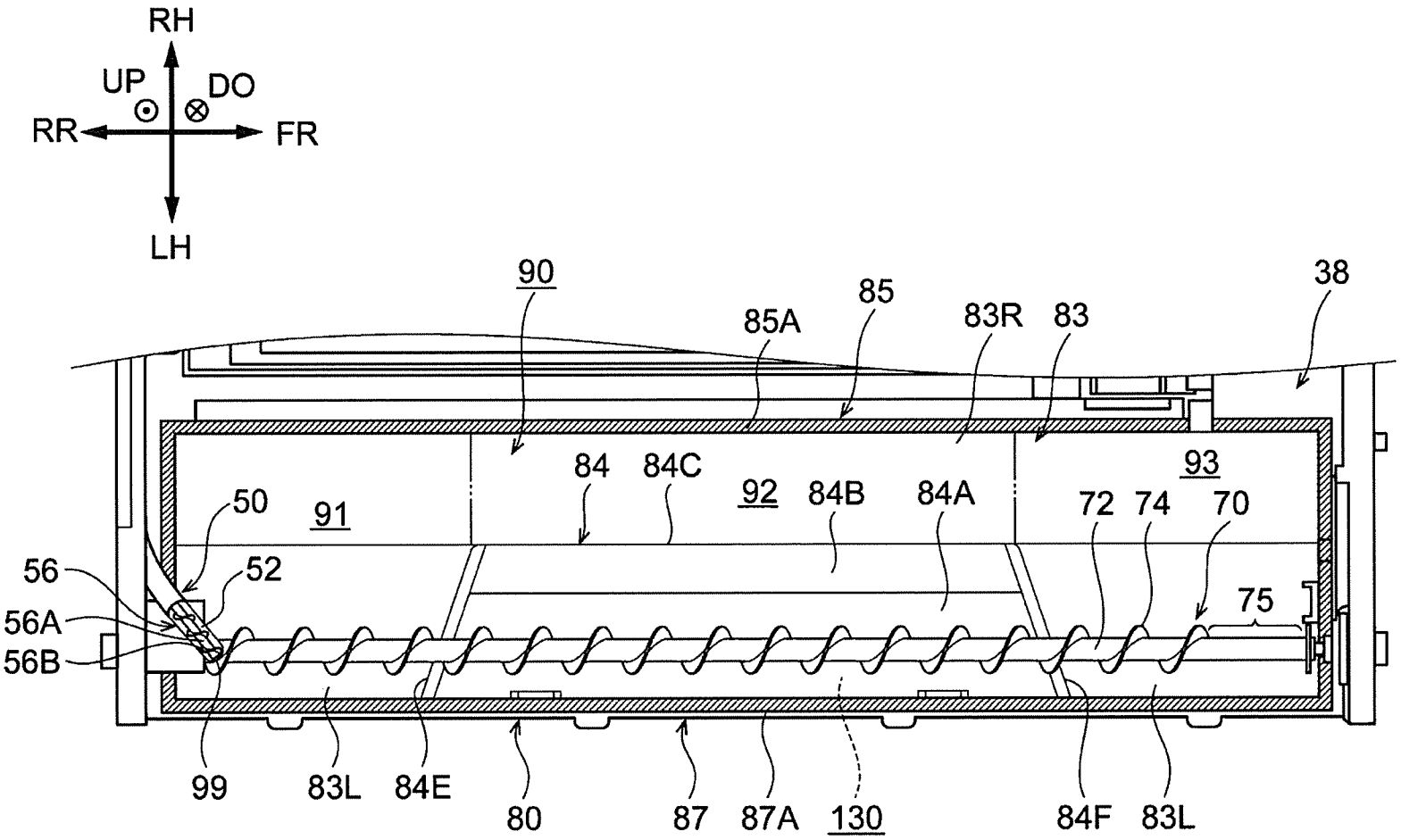
FIG. 9 is a plan sectional view of a waste-toner storage portion according to the exemplary embodiment.

The transport mechanism 50 transports toner removed by the remover 27 to the waste-toner storage portion 38. Specifically, as illustrated in FIGS. 7 and 9, the transport mechanism 50 includes a transport path 52 and a transport member 56.

Figure 8:
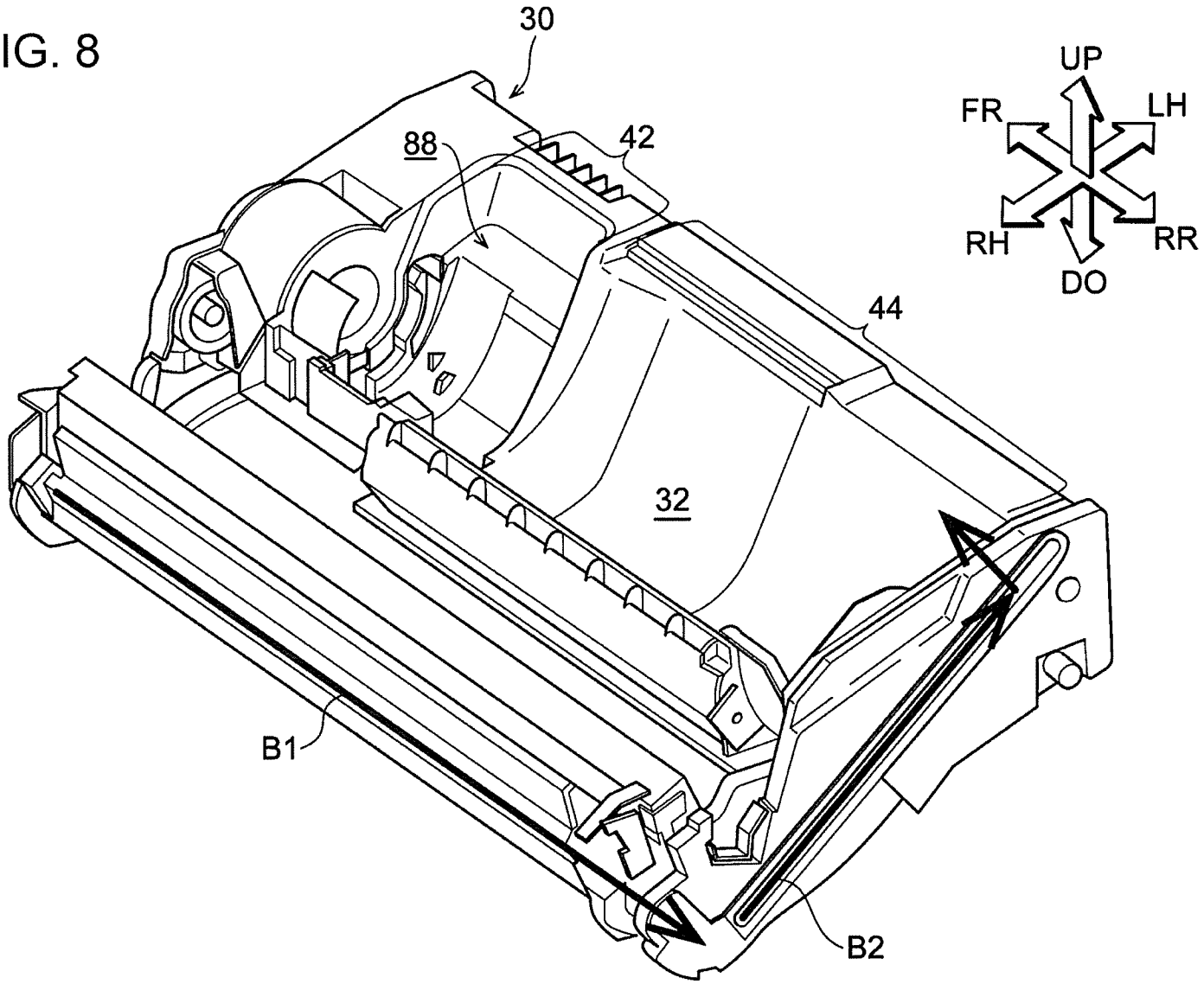
FIG. 8 is a perspective view of the unit body of the image forming unit according to the exemplary embodiment.

As illustrated in FIG. 7, the transport path 52 forms a path along which the toner is transported from the toner storage portion 27B of the remover 27 to the waste-toner storage portion 38. Specifically, as illustrated in FIG. 8, the transport path 52 extends toward the rear side (see arrow B1) at the right end of the unit body 30 and then turns and ascends toward the left side (see arrow B2) at the rear end of the unit body 30.

The transport member 56 has a function of transporting toner and is positioned in the transport path 52. Specifically, as illustrated in FIGS. 7 and 9, the transport member 56 includes a shaft portion 56A, and a blade 56B provided on the outer peripheral surface of the shaft portion 56A helically around the axis of the shaft portion 56A. The transport member 56 is made of, for example, elastically deformable resin (elastomer) and is provided in the transport path 52 with the shaft portion 56A elastically deformed.

Waste-Toner Storage Portion 38

The waste-toner storage portion 38 is an exemplary storage portion. The waste-toner storage portion 38 has a function of storing toner. Specifically, the waste-toner storage portion 38 has a function of storing the toner removed from the photoconductor drum 20 by the remover 27. The toner stored in the waste-toner storage portion 38 is the toner transported from the remover 27 by the transport mechanism 50 and is exemplary powder. More specifically, the toner stored in the waste-toner storage portion 38 is used toner, i.e., waste toner to be disposed of. The waste toner is also regarded as toner removed from an attracting body (the photoconductor drum 20) to which toner is attracted. The attracting body may be any of the charging roller 24, the transfer roller 22, and the like.

The waste-toner storage portion 38 is positioned at the left end of the unit body 30 as illustrated in FIG. 7 and extends in the front-rear direction as illustrated in FIG. 9. The waste-toner storage portion 38 includes a storage space 90 in which waste toner is stored, an outer wall 80 that defines the storage space 90, and an inlet 99.

Figure 10:
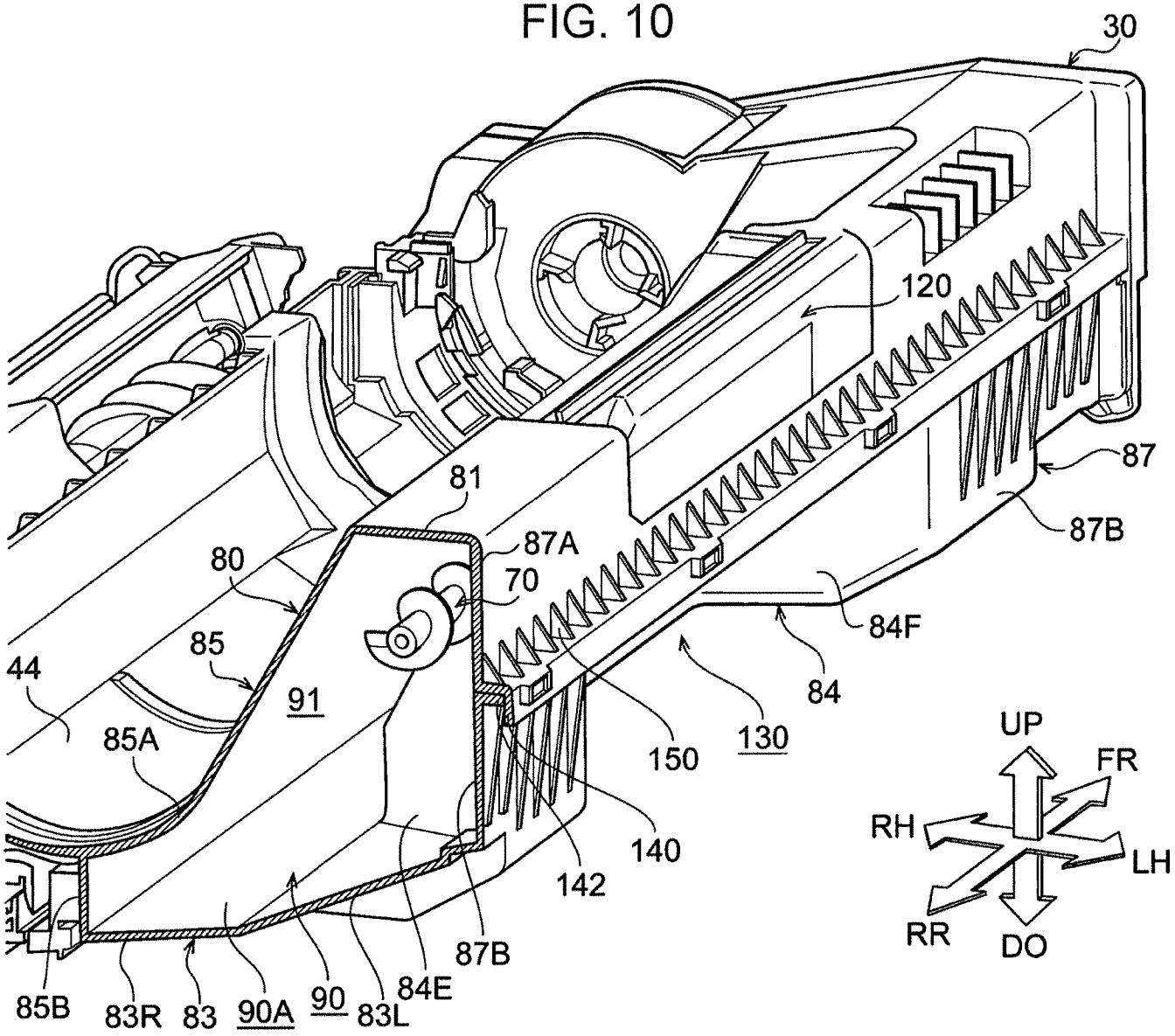
FIG. 10 illustrates a section of the waste-toner storage portion according to the exemplary embodiment that is taken in a first region.
Figure 11:
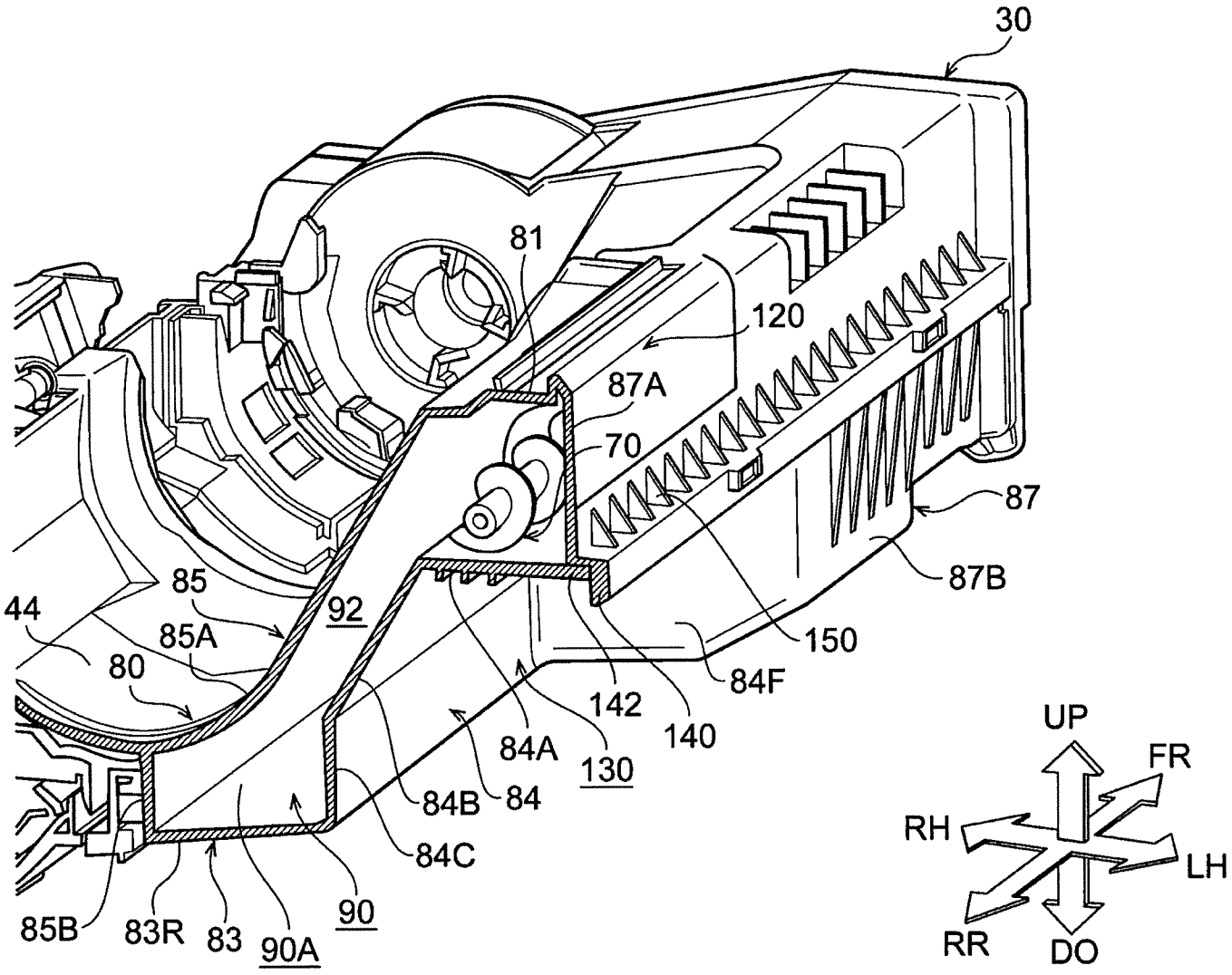
FIG. 11 illustrates a section of the waste-toner storage portion according to the exemplary embodiment that is taken in a second region.
Figure 12:
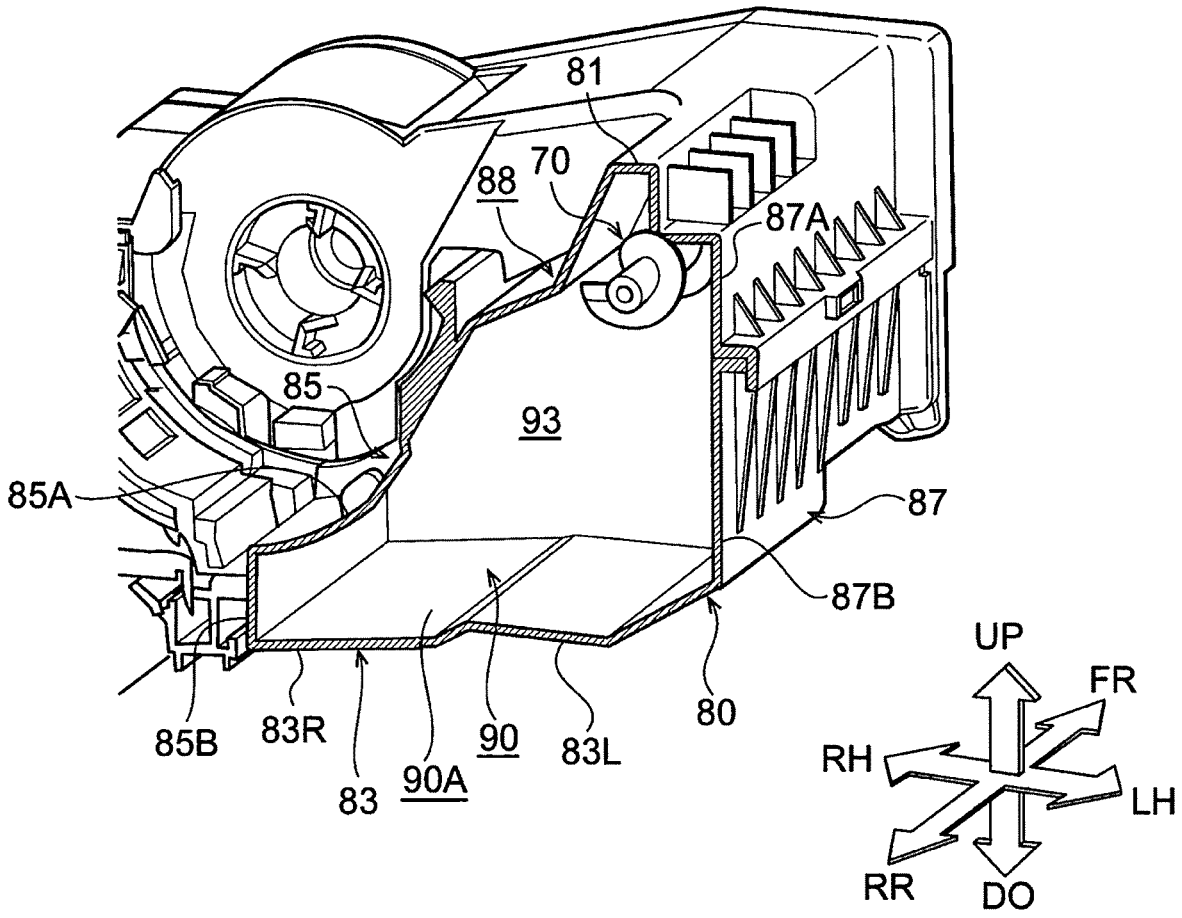
FIG. 12 illustrates a section of the waste-toner storage portion according to the exemplary embodiment that is taken in a third region.
Figure 13:
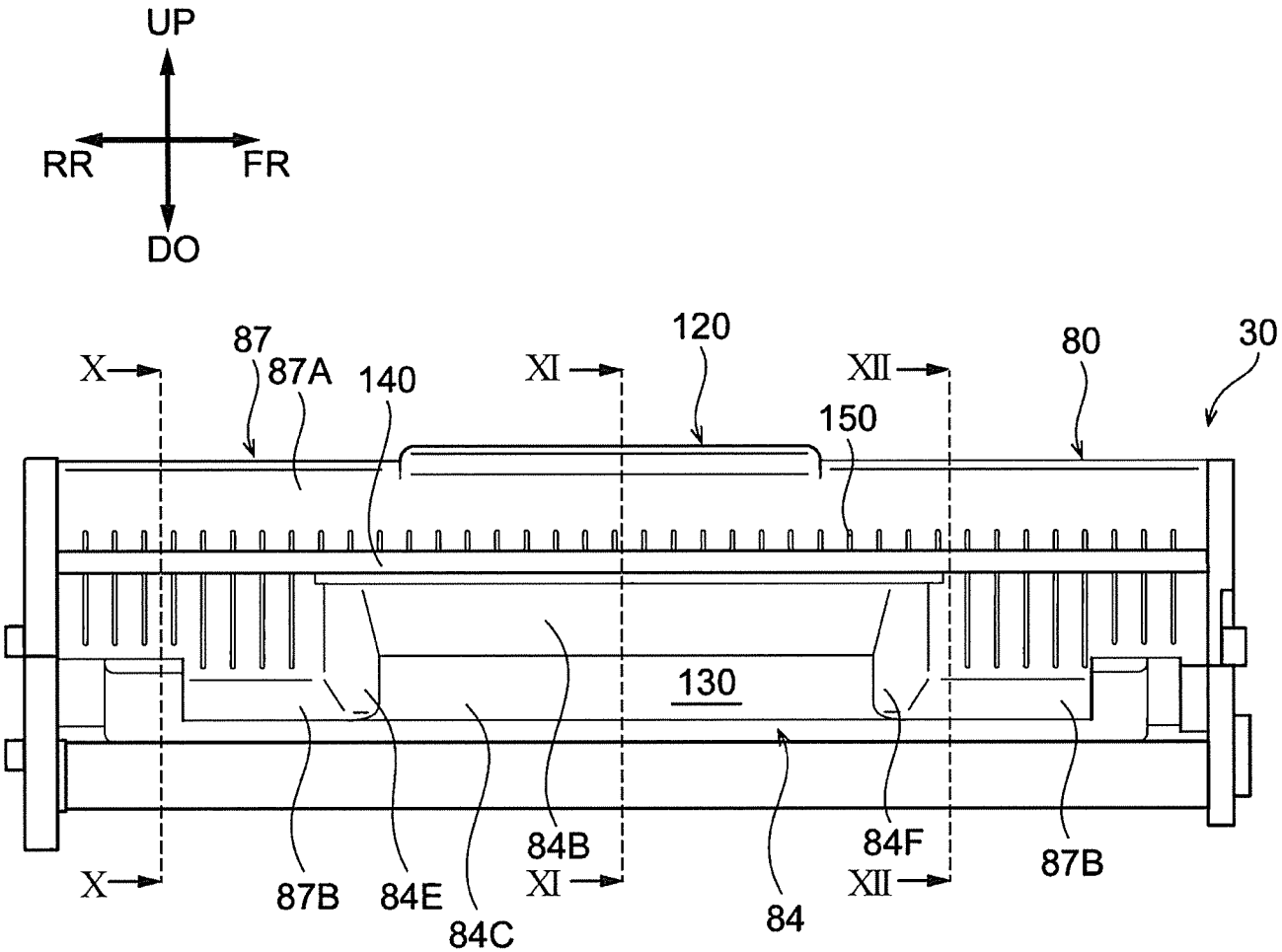
FIG. 13 is a side view of the waste-toner storage portion according to the exemplary embodiment.

As illustrated in FIGS. 10, 11, and 12, the storage space 90 includes a bottom part 90A extending continuously in the front-rear direction. Specifically, the storage space 90 extends continuously in the front-rear direction along an upper surface of a bottom wall 83 (specifically, a right part 83R to be described below) forming part of the outer wall 80. In other words, the waste toner stored in the storage space 90 is allowed to move along the bottom wall 83 from the rear side toward the front side. FIGS. 10, 11, and 12 are sectional views taken along line X-X, line XI-XI, and line XII-XII, respectively, illustrated in FIG. 13.

The storage space 90 of the waste-toner storage portion 38 includes a first region 91, a second region 92, and a third region 93. The first region 91, the second region 92, and the third region 93 are positioned in that order from the rear side toward the front side. That is, the second region 92 is positioned between the first region 91 and the third region 93 in the front-rear direction.

The sectional area of the storage space 90 seen in the front-rear direction (hereinafter simply referred to as "sectional area") is smaller in the second region 92 than in the first region 91. The second region 92 has a smaller sectional area than the third region 93. The third region 93 has a smaller sectional area than the first region 91. That is, the sectional area of the storage space 90 provided in the waste-toner storage portion 38 becomes smaller in order of the sectional area of the first region 91, the sectional area of the third region 93, and the sectional area of the second region 92. The first region 91 and the third region 93 are each an exemplary other region. The second region 92 is an exemplary narrow region having a smaller sectional area than the other regions. The front-rear direction is an exemplary one direction. The term "one direction" is used as "a particular one of several directions".

The inlet 99 illustrated in FIG. 9 is a mouth part from which the toner moves into the storage space 90. The inlet 99 is provided on the rear side of the waste-toner storage portion 38. The rear side is an exemplary upstream side in the direction of transport by the transport member 70.

As illustrated in FIGS. 10, 11, and 12, the outer wall 80 includes an upper wall 81, a right wall 85, the bottom wall 83, a left wall 87, and a defining wall 84. The upper wall 81 is on the upper side of the storage space 90 and has a substantially rectangular plan-view shape elongated in the front-rear direction.

The right wall 85 includes a right slope part 85A and a lower right part 85B. The right slope part 85A extends from the right end of the upper wall 81 obliquely toward the lower right side. The lower portion of the right slope part 85A is curved in an arc shape. The lower right part 85B extends from the lower end of the right slope part 85A toward the lower side. The right slope part 85A of the right wall 85 forms part of the front peripheral wall 42 and part of the rear peripheral wall 44 described above.

The bottom wall 83 includes the right part 83R and left parts 83L. The right part 83R extends from the lower end of the lower right part 85B of the right wall 85 toward the left side. The left parts 83L are provided in the first region 91 and in the third region 93, respectively, and each extend from the left end of the right part 83R toward the left side. The second region 92 has no left part 83L. Accordingly, the bottom wall 83 has a rectangular-U plan-view shape with an open left side.

The left wall 87 includes an upper left part 87A and lower left parts 87B. The upper left part 87A extends from the left end of the upper wall 81 toward the lower side. The lower left parts 87B are provided in the first region 91 and in the third region 93, respectively, and each extend from the lower end of the upper left part 87A toward the lower side. The second region 92 has no lower left part 87B. Accordingly, the left wall 87 has a rectangular-U side-view shape with an open lower side.

The defining wall 84 defines an insertion space 130 (a recess) to be described below. As illustrated in FIG. 11, the defining wall 84 includes an upper part 84A, a slope part 84B, a lower part 84C, a front part 84F, and a rear part 84E (see FIG. 9).

As illustrated in FIG. 11, the upper part 84A extends in the second region 92 from the lower end of the upper left part 87A of the left wall 87 toward the right side. The slope part 84B extends obliquely from the right end of the upper part 84A toward the lower right side. The lower part 84C extends from the lower end of the slope part 84B toward the lower side. The lower end of the lower part 84C is connected to the left end of the right part 83R of the bottom wall 83.

The front part 84F extends from the front end of the upper part 84A toward the lower side. The right end of the front part 84F is connected to the front end of the slope part 84B and to the front end of the lower part 84C. The left end of the front part 84F is connected to the rear end of the front one of the lower left parts 87B of the left wall 87. The lower end of the front part 84F is connected to the rear end of the front one of the left parts 83L of the bottom wall 83.

The rear part 84E extends from the rear end of the upper part 84A toward the lower side. The right end of the rear part 84E is connected to the rear end of the slope part 84B and to the rear end of the lower part 84C. The left end of the rear part 84E is connected to the front end of the rear one of the lower left parts 87B of the left wall 87. The lower end of the rear part 84E is connected to the front end of the rear one of the left parts 83L of the bottom wall 83.

As illustrated in FIG. 9, the front part 84F is inclined toward the rear right side in plan view. The rear part 84E is inclined toward the front right side in plan view. The front part 84F and the rear part 84E face each other at an interval in the front-rear direction.

The first region 91 (see FIG. 10) and the third region 93 (see FIG. 12) are defined by the upper wall 81, the right slope part 85A and the lower right part 85B of the right wall 85, the right part 83R and the left part 83L of the bottom wall 83, and the upper left part 87A and the lower left part 87B of the left wall 87. The first region 91 and the third region 93 have respective sectional areas defined by the foregoing parts of the walls. In the third region 93, a recess 88 that is depressed inward is provided at the corner between the upper wall 81 and an upper portion of the right slope part 85A. Therefore, the sectional area of the third region 93 is smaller than the sectional area of the first region 91. As illustrated in FIG. 6, the recess 88 is a space in which the operated portion 67 is to be positioned.

The second region 92 (see FIG. 11) is defined by the upper wall 81, the right slope part 85A and the lower right part 85B of the right wall 85, the right part 83R of the bottom wall 83, the upper part 84A, the slope part 84B, and the lower part 84C of the defining wall 84, and the upper left part 87A of the left wall 87. The second region 92 has a sectional area defined by the foregoing parts of the walls.

In the present exemplary embodiment, the second region 92 has a smaller width in the horizontal direction of the bottom wall 83 than the first region 91 and the third region 93. The first region 91 and the third region 93 have substantially the same width. The first region 91 and the third region 93 are each an exemplary other region, and the second region 92 is an exemplary narrow region whose width is smaller than the width of the other regions in the horizontal direction of the bottom wall 83.

Transport Member 70

As illustrated in FIG. 9, the transport member 70 extends in the front-rear direction in the storage space 90 and transports waste toner toward the front side. Specifically, the transport member 70 transports waste toner toward the front side such that at least some of the waste toner passes through the second region 92. In other words, the transport member 70 extends from the first region 91 to the third region 93 through the second region 92. The transport member 70 is positioned above the upper part 84A of the defining wall 84.

The transport member 70 includes a shaft portion 72, a blade 74, and an absent part 75. The shaft portion 72 extends in the front-rear direction. The shaft portion 72 has a round-columnar or cylindrical stick shape or the like. The blade 74 has a helical shape and is provided around the outer periphery of the shaft portion 72. The transport member 70 is configured such that the blade 74 transports the waste toner toward the front side (toward one side in the axial direction of the shaft portion 72) with the rotation of the shaft portion 72.

The absent part 75 is a part of the shaft portion 72 where the blade 74 is absent. The absent part 75 is provided on the downstream side with respect to the blade 74 in the direction of transport. The absent part 75 is provided only on the downstream side in the direction of transport with respect to the second region 92 in the front-rear direction. That is, the absent part 75 is positioned in the third region 93. In other words, the absent part 75 is positioned on the front side with respect to the front part 84F of the defining wall 84. Specifically, the absent part 75 is positioned at the front end of the shaft portion 72 with a length in the axial direction that is greater than or equal to one pitch of the blade 74.

The blade 74 is provided on the shaft portion 72 over the entirety of a part on the rear side with respect to the absent part 75. Specifically, the blade 74 extends over the first region 91, the second region 92, and a rear part of the third region 93. In the rear part of the third region 93, the blade 74 has a length corresponding to one pitch or longer.

Other Elements of Image Forming Unit 18

The image forming unit 18 further includes a grip portion 120, the insertion space 130, extended portions 140 and 142, and a plurality of ribs 150.

The grip portion 120 is to be gripped by the worker (the operator) when the image forming unit 18 is attached to or detached from the image-forming-apparatus body 11. The grip portion 120 is formed of a portion of the outer wall 80 that defines the second region 92. Specifically, the grip portion 120 is formed of the upper wall 81, the upper left part 87A of the left wall 87, and the upper part 84A of the defining wall 84. In the present exemplary embodiment, for example, the worker (the operator) grips the grip portion 120 in such a manner as to grab the upper wall 81 and the upper part 84A of the defining wall 84. More specifically, for example, the worker (the operator) grips the grip portion 120 with the thumb of each of his/her two hands being placed on the lower surface of the upper part 84A of the defining wall 84 and the other four fingers being placed on the upper surface of the upper wall 81.

The insertion space 130 is a space at the back of the slope part 84B and the lower part 84C that define the second region 92. Part of the hands is inserted into the insertion space 130 when the grip portion 120 is gripped. In other words, the second region 92 and the insertion space 130 are separated from each other by the slope part 84B and the lower part 84C. The slope part 84B and the lower part 84C are each an exemplary side wall. The insertion space 130 is provided at the lower left end of the unit body 30 in a central part of the unit body 30 in the front-rear direction. The insertion space 130 is open on the left side and on the lower side. The insertion space 130 is defined by the upper part 84A, the slope part 84B, the lower part 84C, the front part 84F, and the rear part 84E of the defining wall 84. That is, the insertion space 130 is provided between the front part 84F and the rear part 84E, with a length in the front-rear direction gradually increasing toward the left side (see FIG. 9).

The extended portion 140 extends from the lower end of the upper left part 87A of the left wall 87 toward the left side. Specifically, the extended portion 140 has an L shape when seen in the front-rear direction. The extended portion 142 extends from the upper end of the lower left part 87B of the left wall 87 and from the left end of the upper part 84A of the defining wall 84 toward the left side. The extended portion 140 and the extended portion 142 are mated to each other in the vertical direction.

The extended portion 140 and the extended portion 142 are provided therebetween with, for example, a sealing material that suppresses toner leakage. In addition, the outer wall 80 is dividable into two pieces (not illustrated) in the vertical direction at, for example, the lower right part 85B.

The plurality of ribs 150 are exemplary projections. The ribs 150 are provided at the corner between the extended portion 140 and the upper left part 87A of the left wall 87. The ribs 150 each have a plate shape with a certain thickness in the front-rear direction. The ribs 150 each has a triangular shape when seen in the front-rear direction. The plurality of ribs 150 are arranged side by side in the front-rear direction at intervals smaller than the width of any finger. That is, the plurality of ribs 150 are arranged at intervals that do not allow any finger to be inserted thereinto. Such projections may be replaced with, for example, a single projection that extends in the front-rear direction and fills the corner between the extended portion 140 and the upper left part 87A of the left wall 87 in the front-rear direction.

In the present exemplary embodiment, the storage portion 62 of the storage container 60 extends in the front-rear direction in such a manner as to be in contact with the right slope part 85A of the right wall 85 forming the rear peripheral wall 44. The storage container 60 is supported in a cantilever manner at the front end, as described above, and is rotatable on the axis extending in the front-rear direction. In other words, in the present exemplary embodiment, the storage container 60 is supported in a cantilever manner on the downstream side in the direction of transport by the transport member 70.

Functions Exerted by Exemplary Embodiment

Functions exerted by the present exemplary embodiment will now be described.

In the present exemplary embodiment, waste toner is transported toward the front side such that at least some of the waste toner passes through the second region 92. Therefore, the second region 92 is positioned in a middle part in the front-rear direction. Specifically, in the present exemplary embodiment, the second region 92 is positioned between the first region 91 and the third region 93 in the front-rear direction.

In the present exemplary embodiment, the second region 92 has a smaller sectional area than the first region 91 and the third region 93.

Here, another configuration (a first comparative embodiment) will be discussed in which the sectional area of the storage space 90 is uniform in the front-rear direction, that is, the second region 92, the first region 91, and the third region 93 all have the same sectional area. In the first comparative embodiment, if the image forming unit 18 detached from the image-forming-apparatus body 11 is tilted as illustrated in FIG. 14, for example, waste toner in the first region 91 of the storage space 90 moves in the bottom part 90A into the third region 93 through the second region 92.

In contrast, in the present exemplary embodiment, the second region 92 has a smaller sectional area than the first region 91 and the third region 93. Therefore, if the image forming unit 18 detached from the image-forming-apparatus body 11 is tilted as illustrated in FIG. 14, for example, waste toner in the first region 91 of the storage space 90 is less likely to pass through the second region 92 than in the first comparative embodiment. Accordingly, even if the image forming unit 18 detached from the image-forming-apparatus body 11 is tilted as illustrated in FIG. 14, the waste toner is less likely to gather toward the front side of the storage space 90 than in the first comparative embodiment.

In the present exemplary embodiment, the second region 92 has a smaller width in the horizontal direction of the bottom wall 83 than the first region 91 and the third region 93.

Figure 14:
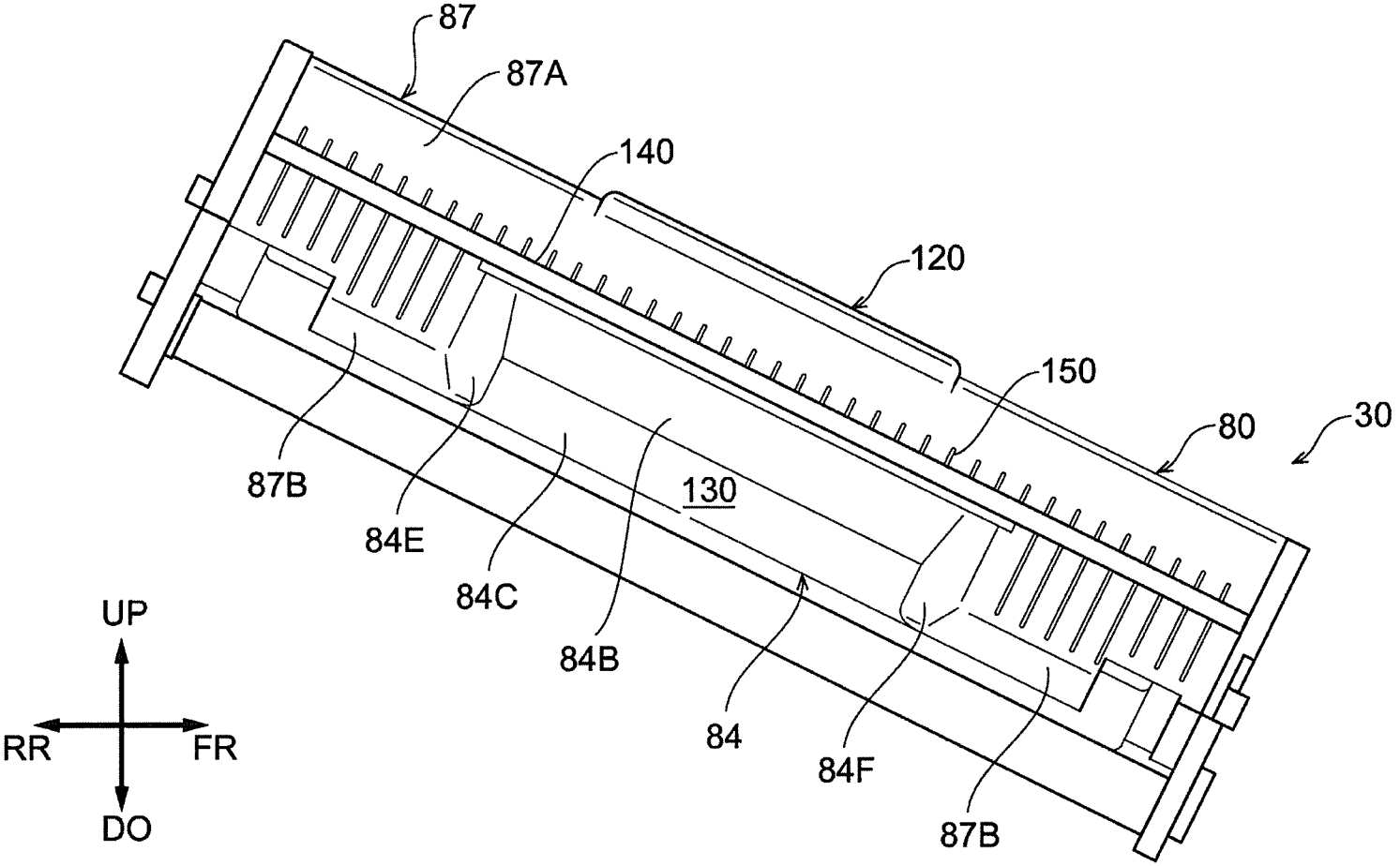
FIG. 14 is a side view of the image forming unit according to the exemplary embodiment that is tilted.

If the image forming unit 18 detached from the image-forming-apparatus body 11 is tilted as illustrated in FIG. 14, for example, waste toner in the first region 91 of the storage space 90 is less likely to pass through the second region 92 along the bottom wall 83 than in a configuration (a second comparative embodiment) in which the width of the bottom wall 83 of the storage space 90 is uniform in the front-rear direction.

Therefore, even if the image forming unit 18 detached from the image-forming-apparatus body 11 is tilted as illustrated in FIG. 14, waste toner in the storage space 90 is less likely to gather toward the front side than in the second comparative embodiment.

In the present exemplary embodiment, the grip portion 120 is formed of a portion of the outer wall 80 (the upper wall 81, the upper left part 87A of the left wall 87, and the upper part 84A of the defining wall 84) that defines the second region 92 positioned in the middle part of the image forming unit 18 in the front-rear direction.

Therefore, the image forming unit 18 is gripped in a more balanced state in weight in the front-rear direction than in a configuration in which the grip portion 120 is formed of a portion of the outer wall 80 that defines the first region 91 or the third region 93.

In the present exemplary embodiment, the insertion space 130 into which part of the hands is to be inserted when the grip portion 120 is gripped is provided at the back of the slope part 84B and the lower part 84C that define the second region 92.

Therefore, the size of the image forming unit 18 is less likely to become large than in a configuration in which the insertion space 130 is defined by a portion of the outer wall 80 that defines the first region 91 or the third region 93.

In the present exemplary embodiment, the ribs 150 are provided at the corner between the extended portion 140 and the upper left part 87A of the left wall 87. Therefore, the worker is less likely to unintentionally grip the extended portion 140 and the extended portion 142 than in a configuration in which the left surface of the upper left part 87A of the left wall 87 and the upper surface of the extended portion 140 are flat at the corner between the extended portion 140 and the upper left part 87A of the left wall 87.

In the present exemplary embodiment, the absent part 75 of the transport member 70 is positioned in the third region 93. Therefore, clogging of waste toner in the second region 92 of the storage space 90 is less likely to occur than in a configuration in which the absent part 75 is positioned in the second region 92.

In the present exemplary embodiment, the storage portion 62 of the storage container 60 supported in a cantilever manner at the front end thereof extends in the front-rear direction in such a manner as to be in contact with the right slope part 85A of the right wall 85 forming the rear peripheral wall 44. Therefore, when the storage portion 62 is rotated, vibration caused by the rotation is transmitted to the right slope part 85A of the right wall 85. Accordingly, toner adhered to the inner surface of the right slope part 85A of the right wall 85 is more likely to fall than in a configuration in which the storage portion 62 is out of contact with the right slope part 85A of the right wall 85.

In the present exemplary embodiment, the storage container 60 corresponds to the rotating body that rotates while being in contact with the right slope part 85A of the right wall 85. Therefore, the number of components is smaller than in a configuration in which the rotating body and the storage container 60 are separate elements.

In the present exemplary embodiment, the storage container 60 is supported in a cantilever manner at the front end. Therefore, when the storage portion 62 is rotated, vibration caused by the rotation is more likely to be transmitted from the rear end of the storage container 60 to the rear end of the right slope part 85A of the right wall 85 than in a configuration in which the storage container 60 is supported in a cantilever manner at the rear end. Accordingly, toner adhered to the inner surface of the outer wall 80 on the rear side of the storage space 90 (the side in the front-rear direction where the inlet 99 is provided) is more likely to fall.

Modifications

In the above exemplary embodiment, the second region 92 has a smaller sectional area than the first region 91 and the third region 93, and the second region 92 has a smaller width than the first region 91 and the third region 93. The present disclosure is not limited to such an embodiment. For example, only one of the sectional area and the width of the second region 92 needs to be smaller than that of the first region 91 and the third region 93.

In the above exemplary embodiment, the ribs 150 are provided at the corner between the extended portion 140 and the upper left part 87A of the left wall 87. The present disclosure is not limited to such an embodiment. For example, the left surface of the upper left part 87A of the left wall 87 and the upper surface of the extended portion 140 may be flat with no ribs 150 at the corner between the extended portion 140 and the upper left part 87A of the left wall 87.

In the above exemplary embodiment, the image forming unit 18 has the extended portions 140 and 142. Alternatively, the extended portions 140 and 142 of the image forming unit 18 may be omitted.

In the above exemplary embodiment, the storage portion 62 of the storage container 60 that is supported in a cantilever manner at the front end extends in the front-rear direction in such a manner as to be in contact with the right slope part 85A of the right wall 85 forming the rear peripheral wall 44. The present disclosure is not limited to such an embodiment. For example, the storage portion 62 may be out of contact with the right slope part 85A of the right wall 85.

In the above exemplary embodiment, the storage container 60 corresponds to the rotating body that rotates while being in contact with the right slope part 85A of the right wall 85. The present disclosure is not limited to such an embodiment. For example, the rotating body and the storage container 60 may be separate elements.

In the above exemplary embodiment, the storage container 60 is supported in a cantilever manner at the front end. The present disclosure is not limited to such an embodiment. For example, the storage container 60 may be supported in a cantilever manner at the rear end.

In the above exemplary embodiment, the image forming unit 18 is regarded as an exemplary attachable-detachable unit. The present disclosure is not limited to such an embodiment. The attachable-detachable unit may be a belt unit including a transfer belt and the waste-toner storage portion 38, or the like. In that case, for example, the waste-toner storage portion 38 stores toner removed from the transfer belt. The attachable-detachable unit may alternatively be a unit including only the waste-toner storage portion 38.

The present disclosure is not limited to the above exemplary embodiment, and various modifications, changes, and improvements may be made thereto within the scope thereof. For example, the above modifications may be combined in any way, according to need.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A cartridge of a printer that is attachable to and detachable from a body of the printer, the cartridge comprising:

a storage portion having a storage space storing toner, the storage space including a bottom part that is continuous in one direction and a narrow region in which the storage space seen in the one direction has a smaller sectional region than in an other region; and a transport member extending in the one direction in the storage space and transporting the toner in the one direction such that at least some of the toner passes through the narrow region, wherein the transport member extends from the other region through the smaller sectional region and the transport member is positioned above the smaller sectional region, the transport member comprises a shaft portion and a blade provided on an outer periphery of the shaft portion and that transports the toner in the one direction, and a grip portion formed of a part of an outer wall of the narrow region and comprises an upper part and a lower part extending in the one direction, and the transport member extending in the one direction is located between the upper part and the lower part of the grip portion.

2. The cartridge according to claim 1, wherein an insertion space into which part of a hand is to be inserted when the grip portion is gripped is provided at a back of a side wall that defines the narrow region.

3. The cartridge according to claim 2, further comprising:

an extended portion extending from the outer wall; and a projection formed at a corner between the extended portion and the outer wall.

4. The cartridge according to claim 3, wherein the transport member includes an absent part, in which the blade is absent, is provided on the shaft portion at a downstream side in a transport direction relative to the blade, the transport direction is a direction in which the transport member transports the toner, and wherein the absent part is provided only on the downstream side in the transport direction with respect to the narrow region in the one direction.

5. The cartridge according to claim 2, wherein the transport member includes an absent part, in which the blade is absent, is provided on the shaft portion at a downstream side in a transport direction relative to the blade, the transport direction is a direction in which the transport member transports the toner, and wherein the absent part is provided only on the downstream side in the transport direction with respect to the narrow region in the one direction.

6. The cartridge according to claim 1, further comprising:

an extended portion extending from the outer wall; and a projection formed at a corner between the extended portion and the outer wall.

7. The cartridge according to claim 6, wherein the transport member includes an absent part, in which the blade is absent, is provided on the shaft portion at a downstream side in a transport direction relative to the blade, the transport direction is a direction in which the transport member transports the toner, and wherein the absent part is provided only on the downstream side in the transport direction with respect to the narrow region in the one direction.

8. The cartridge according to claim 6, wherein the extended portion has an L shape when being seen from the one direction.

9. The cartridge according to claim 1, wherein the transport member includes an absent part, in which the blade is absent, is provided on the shaft portion at a downstream side in a transport direction relative to the blade, the transport direction is a direction in which the transport member transports the toner, and wherein the absent part is provided only on the downstream side in the transport direction with respect to the narrow region in the one direction.

10. The cartridge according to claim 1, further comprising:

a rotating body extending in the transport direction in such a manner as to be in contact with an outer wall that defines the storage space, the rotating body being supported in a cantilever manner at one end and rotating on an axis extending in the transport direction.

11. The cartridge according to claim 10, wherein the rotating body is a storage container that stores toner to be supplied to a supply destination.

12. The cartridge according to claim 11, wherein the storage portion has, on an upstream side in the transport direction, an inlet from which the toner moves into the storage space, and wherein the one end of the rotating body is supported in a cantilever manner on the cartridge at a downstream side in the transport direction relative to the cartridge.

13. The cartridge according to claim 10, wherein the storage portion has, on an upstream side in the transport direction, an inlet from which the toner moves into the storage space, and wherein the one end of the rotating body is supported in a cantilever manner on the cartridge at a downstream side in the transport direction relative to the cartridge.

14. The cartridge according to claim 1, wherein the storage portion is integrally molded from a resin material.

15. The cartridge according to claim 1, wherein the transport member is made from an elastically deformable resin with the shaft portion elastically deformed.

* * * * *